United States Patent [19]

Sarkanen

[11] 4,329,200

[45] May 11, 1982

[54] METHOD AND SYSTEM FOR SELECTIVE ALKALINE DEFIBERIZATION AND DELIGNIFICATION

[75] Inventor: Kyosti V. Sarkanen, Seattle, Wash.

[73] Assignee: Board of Reagents, University of Washington, Seattle, Wash.

[21] Appl. No.: 155,244

[22] Filed: Jun. 2, 1980

[51] Int. Cl.[3] ..... D21C 3/20

[52] U.S. Cl. ..... 162/77; 162/82

[58] Field of Search ..... 162/82, 77

[56] References Cited

U.S. PATENT DOCUMENTS

| | | | |
|---|---|---|---|
| 1,817,525 | 8/1931 | Richter | 162/82 |
| 1,891,337 | 12/1932 | Seaman | 162/82 |
| 2,003,347 | 6/1935 | Dreyfus | 162/77 |
| 2,166,540 | 7/1939 | Bailey | 162/77 |
| 3,513,068 | 5/1970 | Starr et al. | 162/77 |

*Primary Examiner*—William F. Smith

*Attorney, Agent, or Firm*—Jerome S. Marger

[57] ABSTRACT

A method is provided for selectively defiberizing and delignifying lignocellulose employing a novel alkaline pulping system. The subject pulping system includes a pulping liquor comprising water, a water-miscible organic reagent, and a sulfide or bisulfide compound selected from the group consisting of alkali metal sulfides and bisulfides, ammonium sulfide and ammonium bisulfide. Extremely high pulp yields as compared to kraft pulping are provided by employing the method and system of this invention.

17 Claims, No Drawings

METHOD AND SYSTEM FOR SELECTIVE ALKALINE DEFIBERIZATION AND DELIGNIFICATION

BACKGROUND OF THE INVENTION

The invention described herein was made during the course of, or under, a grant from the National Science Foundation. The Government has rights in this invention pursuant to Contract Number AER-77-08979 awarded by the National Science Foundation.

This invention relates to a novel method and system which may selectively produce a substantially fiberized, substantially delignified, high yield cellulosic pulp. In general, pulping to produce cellulose fibers is accomplished by defibering and delignifying lignocellulose by various well-known pulping techniques. One object in pulping is to defiber the lignocellulose, i.e., liberate the cellulosic fibers from the lignocellulose. In chemical pulping the lignocellulose is defibered with a chemical pulping liquor. Another object is delignification of the lignocellulose, i.e., removal of substantially all of the lignin which surrounds the individual cellulosic fibers, to produce a substantially lignin-free cellulosic fiber without substantial degradation of the cellulose (polysaccharide) structure. Substantial degradation of the cellulose during pulping reduces the strength of the pulped cellulose fibers and lowers the pulp yield.

The prior art describes various pulping processes employing acid, neutral, and alkaline pulping agents, respectively. Acid pulping tends to reduce the strength properties of the cellulose pulp more than alkaline pulping, causing the disadvantages previously described. Therefore, alkaline pulping, which is represented for the most part by the kraft (sulfate) pulping process, is extensively employed and produces pulps having yields of about 46–48% by weight at a lignin content equivalent to a kappa number of about 30. The kappa number is determined by TAPPI T-236.

In an effort to conserve lignocellulose due to its accelerating price, alkaline pulping processes which produce cellulosic pulp at higher yields than by the kraft process have become quite attractive. One of these higher yield pulping processes employs ammonium sulfide as the pulping agent. The use of ammonium sulfide in pulping was originally described in U.S. Pat. No. 1,891,337 to Seaman, and U.S. Pat. No. 1,817,525 to Richter. The use of ammonium sulfide as a pulping chemical was more recently studied at the Pulp and Paper Research Institute of Canada. This work is described in two articles in the Pulp and Paper Magazine of Canada. The first article, which was authored by J. E. Stone and L. F. Nickerson, appeared in the September 1961 issue, beginning at page T-429. A second article was written by J. E. Stone, A. M. Scallan and H. H. Atilla, and appeared in Volume 74, No. 6, in the June 1973 Edition, beginning at page 75. The first article concludes that ammonium sulfide is an effective pulping agent and that the composition of the pulps and the physical properties of the handsheets prepared therefrom compared favorably with both kraft and neutral sulfite pulps. The second article concludes that the optimum conditions for ammonium sulfide pulping of spruce wood are an ammonium sulfide concentration of 0.5 M at 170° C. The pulp yields, at a given lignin content, were much higher than for the same pulp prepared by the kraft process. However, this method produces pulp of dark color, with high residual lignin levels, particularly in the case of pulps made from softwoods.

Another method proposed for delignifying lignocellulose is described in U.S. Pat. Nos. 1,856,567 and 3,585,104, both to Kleinert. The Kleinert processes describe the use of a mixture of water and a water-miscible, volatile organic solvent, preferably a lower aliphatic alcohol or ketone, or mixture thereof, as a pulping agent. Screened pulp yields of 50–57%, using ethanol as the pulping agent, were reported by Kleinert in the August 1974 Edition of TAPPI, Volume 57, No. 8, beginning at page 99. In U.S. Pat. No. 4,100,016 to Diebold et al., which purports to be an improvement of the Kleinert processes, in column 1, beginning at line 7, alcohol pulping, as provided by the above Kleinert patents, is described. It is stated in the Diebold patent that processes such as Kleinert ". . . have shown serious limitations with respect to lignin removal, quality and ease of bleachability of the crude pulp . . .".

SUMMARY OF THE INVENTION

In contradistinction to the previously described prior art systems and methods for pulping lignocellulose, the selected method and system of this invention may produce a substantially fiberized, substantially delignified cellulosic pulp which has a substantially higher pulp yield at a given lignin content than pulps produced by, for example, kraft or soda-anthraquinone pulping methods, or pulps made according to the teachings of J. E. Stone et al. (ammonium sulfide per se) and Kleinert (alcohol per se), respectively. As for the two latter references, the subject method and system may also exhibit substantially higher physical properties as well.

The subject method contemplates the formation of an aqueous alkaline pulping system comprising lignocellulose, and a pulping liquor including water and a pulping agent. The pulping agent comprises a water-miscible organic reagent, and a sulfide or bisulfide compound selected from the group consisting of alkali metal sulfides and bisulfides, and ammonium sulfide and ammonium bisulfide, and mixtures thereof. The initial pH of the alkaline pulping system is preferably greater than a pH of about 7.0, up to a pH of about 12.5. Pulping occurs when the lignocellulose and pulping liquor are heated to an elevated temperature for a period of time sufficient to selectively produce the substantially fiberized, substantially delignified cellulosic pulp.

In the preferred case, the water-miscible organic material is selected from the group consisting of aliphatic alcohols, aliphatic ketones, and aliphatic glycols, and mixtures thereof. Of particular preference are aliphatic alcohols, aliphatic ketones, and aliphatic glycols having from 1 to 6 carbon atoms, the aliphatic alcohols being the more preferred of this group. However, the most preferred compounds for use as water-miscible organic solvents are methanol and/or ethanol.

Of the sulfide or bisulfide compounds described above, sodium sulfide and/or ammonium sulfide are the most preferred.

DETAILED DESCRIPTION OF THE INVENTION

Almost any lignocellulosic material can provide the source of cellulose for the method and system of this invention. More particularly, the lignocellulose starting material can comprise the usual species of coniferous pulpwood (softwood), including spruce, hemlock, fir, pine, and the like, as well as deciduous pulpwood (hardwood) such as oak, poplar, birch, cottonwood, alder, etc., generally in the form of wood chips, as well as other lignocellulosic materials including cotton linters, bagasse, cornstalks, esparto, flax, jute, kenaf, and the like. It should be noted with respect to the above pulpwoods that the deciduous varieties are easier to pulp since they contain less lignin, and the lignin, itself, is more responsive to pulping in the case of hardwoods than in their softwood counterparts. Thus, although certain processes, such as the previously described ammonium sulfide process of Stone et al., have exhibited some degree of effectiveness with respect to hardwoods, their effectiveness with respect to pulping softwoods is limited.

The pulping process of the present invention is performed in an aqueous environment. The relationship of water to the lignocellulose and to the pulping agent will hereinafter be described.

The pulping liquor of this invention comprises two components. One of the components is a water-miscible organic reagent, or a mixture of such reagents. Typical materials for use as the water-miscible organic reagent are selected from the group consisting of aliphatic alcohols, aliphatic ketones, aliphatic glycols, and mixtures thereof. Preferably, the above aliphatic reagents are those compounds having organic moieties comprising 1 to 6 carbon atoms, and more preferably aliphatic alcohols having from 1 to 6 carbon atoms. Of the preferred aliphatic alcohols, methanol and/or ethanol are the most preferred.

Generally, for ease of operation, a solution of water containing the water-miscible organic reagent is first formulated. Although the amount of water-miscible organic reagent can be quite high, the practical aspects suggest limiting its use. Preferably, the ratio of water to water-miscible organic reagent, on a volume percent basis, is 30:70, up to about 90:10, and more preferably from about 50:50, up to about 80:20.

The second component in the system which forms the pulping agent is a sulfide or bisulfide compound selected from the group consisting of alkali metal sulfides and bisulfides, and ammonium sulfide and ammonium bisulfide, and mixtures thereof. Of the above described sulfide and bisulfide compounds, however, ammonium sulfide and/or sodium sulfide are the most preferred. Preferably, the amount of sulfide compound in the aqueous pulping system, which is controled by the cost of the pulping agent, is from about 0.10 M to about 2.0 M, and more preferably from about 0.15 M to about 1.5 M, and most preferably from about 0.20 M to about 1.0 M.

The water and pulping agent together form the "pulping liquor" for delignifying and fiberizing the lignocellulosic starting material. The ratio of pulping liquor to lignocellulose is maintained at a level sufficient for effective delignification and fiberization without substantially degrading the cellulose, and without extending the pulping processes beyond a reasonable time for commercial purposes. Preferably, the pulping liquor-to-lignocellulose ratio is from 3.5:1, up to 15:1, and more preferably from about 4:1, up to about 10:1.

The initial pH of the aqueous pulping system is preferably controled from greater than about 7.0, up to a pH of about 12.5. This minimizes the degradation of the polysaccharide components of the cellulose fiber structure. More preferably, the pH of the aqueous pulping system is from a pH of from about 8.0, up to a pH of about 12.0, and a pH of from about 8.5, up to about a pH of 11.0 being the most preferred.

The lignocellulose is added to the pulping liquor described above and is pulped at an elevated temperature for a period of time sufficient to selectively produce said substantially fiberized, substantially delignified cellulosic pulp. Selectivity herein is defined as the ability to substantially defiber the lignocellulose, and to substantially delignify same, without substantial degradation of the polysaccharide structure of the cellulosic fiber. Preferably, the temperature for pulping the lignocellulose is from about 150° C., up to about 190° C., and more preferably from about 155° C., up to about 180° C., and most preferably from about 160° C., up to about 170° C.

The subject time period to complete the above described pulping method is variable, depending upon the temperature, the aqueous pulping system employed, and the desired lignin content of the cellulosic pulp product. From a practical standpoint, a period of time in excess of 8 hours would probably be limiting from a commercial standpoint. The further preferred limits for pulping time are from about 0.5 hour, up to about 6 hours, and most preferably from about 1 hour, up to about 5 hours.

EXAMPLE 1

To illustrate the unexpected increase in total yield achieved by the method and system of the present invention, a hardwood (cottonwood) pulp was produced by similar methods, including the use of ammonium sulfide as a component of the pulping liquor, except that the aqueous pulping system in a first experiment included 50% by volume of a water-miscible organic reagent in place of that portion of water, i.e., ethanol, and in the second experiment, water only was employed. In fact, at least twice the molar concentration of ammonium sulfide was employed in Experiment 2 than was employed in Experiment 1.

In Experiment 1, an autoclave supported in an insulated, rocking heating block was charged with 5 grams of oven-dried cottonwood wafers and 50 milliliters of a pulping liquor comprising water and ethanol in a 50%:50% ratio by volume and an amount of ammonium sulfide sufficient to produce a pulping liquor having a 0.5 molar concentration. The autoclave was sealed and directly heated to a temperature of 170° C. After a three-hour reaction period at the 170° C. temperature, the autoclave was cooled, opened, and the contents added to about 150 milliliters of ethanol and water. The above mixture was then disintegrated in a Waring Blendor, filtered, washed once with ethanol and water, and then washed with water only, and air-dried. The kappa number of the pulp produced according to the above method was 19.5, and the total pulp yield was 66.5%.

The above experiment was repeated in Experiment 2, except that no ethanol was included in the pulping liquor. After collecting the pulp and air-drying same, as previously described, it was determined that the total yield at 30 kappa number of this latter pulp was about 60%.

Therefore, a substantial, unexpected difference in the total yield, i.e., 6%, resulted when ethanol was added as a pulping agent to the aqueous ammonium sulfide-containing pulping liquor, at a substantially lower kappa number, i.e., 19.5 versus 30.

The above procedure was again repeated in two additional experiments at a temperature of 160° C. and a pulping time period of 6 hours. In the first experiment, 0.25 M ammonium sulfide in 50:50 ethanol-water was employed, while in the second experiment, a four-fold greater amount of ammonium sulfide solution (1.0 M) in water only was provided. In spite of the above disparity in sulfide compound usage, the ammonium sulfide-ethanol-water pulping liquor produced a substantially fiberized, substantially delignified pulp having a high yield (66.5% versus 61%), at a lower kappa number (27.5 versus 36.5).

EXAMPLE 2

Cottonwood wafers were pulped, according to the procedure outlined in Example 1, Experiment 1, except that the ammonium sulfide was not present in the pulping liquor. A series of three pulping runs was conducted at a temperature of 180° C. for a period of time of 0.75 hour (Run No. 1), 1.0 hour (Run No. 2), and 1.5 hours (Run No. 3), respectively. The kappa number and total yield for these reactions are shown below in Table 1.

TABLE

| Run No. | Kappa No. | Total Yield |
|---|---|---|
| 1 | 69 | 56.8 |
| 2 | 37 | 52.0 |
| 3 | 37 | 49.7 |

It should be noted that total yield for cottonwood wafers employing the conventional kraft pulping process at a kappa number of 37 is about 55%. Therefore, it is clear that the total yield employing a 50% volume ratio of ethanol and water per se as the pulping agent, without ammonium sulfide, produces a total yield not only substantially lower than provided by the method and system of the present invention, but even lower than that which is produced by the kraft process.

EXAMPLE 3

In order to examine the system and method of the present invention with respect to softwood, which, as previously described, is far more difficult to pulp than hardwoods such as cottonwood, and the like, Douglas fir softwood chips were pulped according to the following experimental procedure:

Using a 12-liter circulating liquor pulping digester, 1 kilogram of air-dried Douglas fir chips was added to 8 kilograms of 0.51 M ammonium sulfide (Experiment 1). Pulping was conducted at a temperature of 180° C. for 5 hours. The liquor-containing pulp was then blown down into a second digester to which about 8 kilograms of water at 250° C. had previously been added and the mixture circulated for about 2 minutes. This procedure was repeated and the washed pulp recovered. The pulp was then broken up by mild agitation (about 1,750 rpm) with a 4-inch diameter plate stirrer.

The above experiment was repeated (Experiment 2), except that, instead of the ammonium sulfide solution containing only water, a 50:50 volume percent water-ethanol solution was employed. The results of these two experiments are summarized in Table 2 below:

TABLE 2

| | Experiment 1 | | | Experiment 2 | | |
|---|---|---|---|---|---|---|
| Total yield | 67.4% | | | 62.3% | | |
| Screenings | 18.8% | | | 3.0% | | |
| Kappa No. | 141.7 | | | 52.7 | | |
| Canadian Standard Freeness | 600 | 500 | 400 | 600 | 500 | 400 |
| Brightness, Elrepho | 6.1 | 6.5 | 6.5 | 7.7 | 7.6 | 7.4 |
| Burst Factor, $m^2$ | 44.5 | 51.6 | 55.5 | 65.3 | 69.1 | 72.9 |
| Tear Factor, $dm^2$ | 110.9 | 105.7 | 99.2 | 108.0 | 99.8 | 91.6 |
| Fold, MIT | 342 | 496 | 570 | 461 | 521 | 581 |
| Breaking Length, meters | 8,548 | 9,167 | 9,447 | 9,588 | 9,954 | 10,320 |
| Stretch, % | 2.76 | 3.07 | 3.17 | 3.48 | 3.44 | 3.40 |
| TEA, Kg met/$met^2$ | 7.21 | 8.74 | 9.98 | 12.47 | 12.45 | 12.43 |

It can be concluded from the above results that pulp produced by the method of the present invention (Experiment 2) effectively delignified and fiberized the Douglas fir chips. This is clear from the fact that less than 5% screenings, which is the normal measure of acceptable defiberizing, and, in fact, only 3% screening was produced employing the method of the present invention. This is contrasted to 18.8% screening present in Experiment 1 in which ammonium sulfide and water only were employed as the pulping liquor. Furthermore, the kappa number of 141.7 in Experiment 1 clearly indicates that substantially no delignification occurred with the ammonium sulfide-water liquor system, as compared to the ammonium sulfide-ethanol-water pulping system in which a kappa number of 52.7 was achieved. Finally, the physical properties of the screened pulp produced in Experiment 2 were far superior to those of the ammonium sulfide-water system, further verifying the nature of the results which were obtained herein. Of most significance are the average increases in burst (37%), stretch (15%), and TEA (44%).

EXAMPLE 4

The procedure of Example 3 was repeated, using 50% by volume methanol instead of ethanol with softwoods. The reaction was conducted at a temperature of 170° C. The total pulp produced was refined in a PFI mill and the results of experiments using Douglas fir (Experiment 1) and hemlock (Experiment 2) are summarized below and compared to typical, unbleached Douglas fir pulps prepared by the conventional kraft process.

TABLE 3

| | Experiment 1 | | | Experiment 2 | | | *Kraft Process |
|---|---|---|---|---|---|---|---|
| Species | Douglas Fir | | | Hemlock | | | Douglas Fir |
| Yield | 68% | | | 70% | | | 55% |
| Kappa No. | 77 | | | 85 | | | 85 |
| Canadian Standard Freeness | 600 | 500 | 400 | 600 | 500 | 400 | 550–600 |
| Burst Factor, $m^2$ | 57 | 60 | 61 | 71 | 73 | 73 | 50 |
| Tear Factor $dm^2$ | 91 | 82 | 75 | 78 | 70 | 66 | 190 |

TABLE 3-continued

| | Experiment 1 | | | Experiment 2 | | | *Kraft Process |
|---|---|---|---|---|---|---|---|
| Breaking Length, meters | 8,500 | 9,000 | 9,300 | 10,680 | 10,880 | 10,733 | 6,500 |
| Stretch, % | 3.1 | 3.3 | 3.4 | 3.1 | 3.2 | 3.2 | 2.5 |

*Typical physical properties for unbleached kraft handsheets.

It is clear from examining the results above that pulp produced by the subject process compared favorably to kraft pulping in most of the physical properties listed above and had a 13% or better yield improvement over kraft pulps.

I claim:

1. A method for selectively producing a substantially fiberized, substantially delignified, high yield cellulosic pulp, which comprises (a) forming an aqueous pulping system comprising lignocellulose, a pulping liquor including water and a pulping agent, said pulping agent comprising a water-miscible organic reagent selected from the group consisting of aliphatic alcohols, aliphatic ketones, and mixtures thereof, and a sulfide or bisulfide compound selected from the group consisting of ammonium sulfide and ammonium bisulfide, and mixtures thereof; and (b) pulping said lignocellulose at an elevated temperature for a time sufficient to selectively produce said substantially fiberized, substantially delignified cellulosic pulp.

2. The method of claim 1, wherein said water-miscible reagent is an aliphatic ketone having from 1 to 6 carbon atoms.

3. The method of claim 1, wherein said water-miscible reagent is an aliphatic alcohol having from 1 to 6 carbon atoms.

4. The method of claim 3, wherein the aliphatic alcohol is ethanol.

5. The method of claim 3, wherein the aliphatic alcohol is methanol.

6. The method of claim 1, wherein the initial pH of the system is from a pH of greater than about 7.0, up to a pH of about 12.5.

7. The method of claim 1, wherein said initial pH is from about 8.0, up to about 12.0.

8. The method of claim 1, wherein the elevated temperature is from about 150° C., up to about 190° C.

9. The method of claim 1, wherein the time period for conducting the defiberization-delignification is from about 0.5 hour, to about 6 hours.

10. An aqueous pulping system capable of selectively producing a substantially fiberized, substantially delignified, high yield, cellulosic pulp, which comprises (a) lignocellulose;

(b) water;

(c) a water-miscible organic reagent selected from the group consisting of aliphatic alcohols, aliphatic ketones, and mixtures thereof; and (d) a sulfide or bisulfide compound selected from the group consisting of ammonium sulfide and ammonium bisulfide, and mixtures thereof.

11. The system of claim 10, wherein said water-miscible reagent is an aliphatic alcohol having from 1 to 6 carbon atoms.

12. The system of claim 10, wherein the aliphatic alcohol is methanol.

13. The system of claim 10, wherein the water-miscible reagent is an aliphatic ketone having from 1 to 6 carbon atoms.

14. The aqueous pulping system of claim 10, wherein the reagent is methanol.

15. The aqueous pulping system of claim 10, wherein the initial pH of the system is from about greater than a pH of about 7.0, up to a pH of about 12.5.

16. The aqueous pulping system of claim 10, wherein said initial pH is from about 8.0, up to about 12.0.

17. The system of claim 10, wherein the reagent is ethanol.

* * * * *